United States Patent [19]

Osborne

[11] Patent Number: 4,681,990

[45] Date of Patent: Jul. 21, 1987

[54] ELECTRIC BY-PASS SWITCH

[75] Inventor: Anthony Osborne, Duluth, Ga.

[73] Assignee: Kearney-National, Inc., Atlanta, Ga.

[21] Appl. No.: 907,239

[22] Filed: Sep. 15, 1986

[51] Int. Cl.[4] ..... H01H 31/04

[52] U.S. Cl. ..... 200/48 KB; 200/48 V; 200/162

[58] Field of Search ..... 200/48 R, 48 P, 48 A, 200/48 KB, 48 V, 48 SB, 48 CB, 49, 15, 17 R, 162

[56] References Cited

U.S. PATENT DOCUMENTS 2,879,348 3/1959 Ortwig ..... 200/48 R X 3,172,979 3/1965 Yonkers ..... 200/48 R X

*Primary Examiner*—A. D. Pellinen

*Assistant Examiner*—Morris Ginsburg

*Attorney, Agent, or Firm*—Rodgers & Rodgers

[57] ABSTRACT

An electric switch of the by-pass type having a pair of main fixed contacts insulated from each other which cooperates with a pair of main movable contacts which are insulated from each other is provided with a by-pass switch for electrically connecting and disconnecting the main fixed contacts on which a latch is movably mounted and having a part engageable with a fixed latch engaging element so as positively to lock the by-pass switch in closed position, the latch being operated by an actuator mounted on and movable with the main movable contacts for imparting latching movement to the latch in coordination with opening of the main movable contacts. Conversely the actuator unlatches the latch in coordination with closing movement of the main movable contacts.

15 Claims, 13 Drawing Figures

ELECTRIC BY-PASS SWITCH

TECHNICAL FIELD

This invention relates to electric switches which are specially constructed to function as a by pass device for use in conjunction with regulators and other electric components.

BACKGROUND ART

U.S. Pat. No. 3,255,322 issued June 7, 1966 discloses a regulator by-pass switch in which the by-pass element is pivotally mounted at one end and pivotally connected at its opposite end with a link whose movement is responsive to opening of the main disconnect switch to effect closing of the by-pass switch. This operating link is said to constitute a part of a toggle structure for holding the by-pass switch closed. The toggle linkage as disclosed is said to be maintained in a position to hold the by-pass switch closed by means of a spring and the resilient action of a pair of loop contacts between which the by-pass switch element is said to be sandwiched also is said to aid in holding the by-pass switch element closed. This arrangement may not effect a positive and secure latching action whereby the by-pass switch is positively locked in closed position in view of the somewhat uncertain action of the resilient loop contacts and of the toggle biasing spring.

DISCLOSURE OF THE INVENTION

According to this invention in one form, an electric switch having main fixed contacts insulated from each other which cooperate with a pair of main movable contacts insulated from each other is provided with a by-pass switch electrically connected with and pivotally mounted at one end on one of the main fixed contacts and arranged so that its other end electrically connects the other main fixed contact together with latch means movably mounted on the by-pass switch and arranged to latch the by-pass switch closed by positively engaging a latching element together with actuator means mounted on and movable with the main movable contacts for imparting latching and unlatching movement to the latch means in coordination with opening and closing movement of the main movable contacts respectively.

BEST MODE OF CARRYING OUT THE INVENTION

Figure 1:
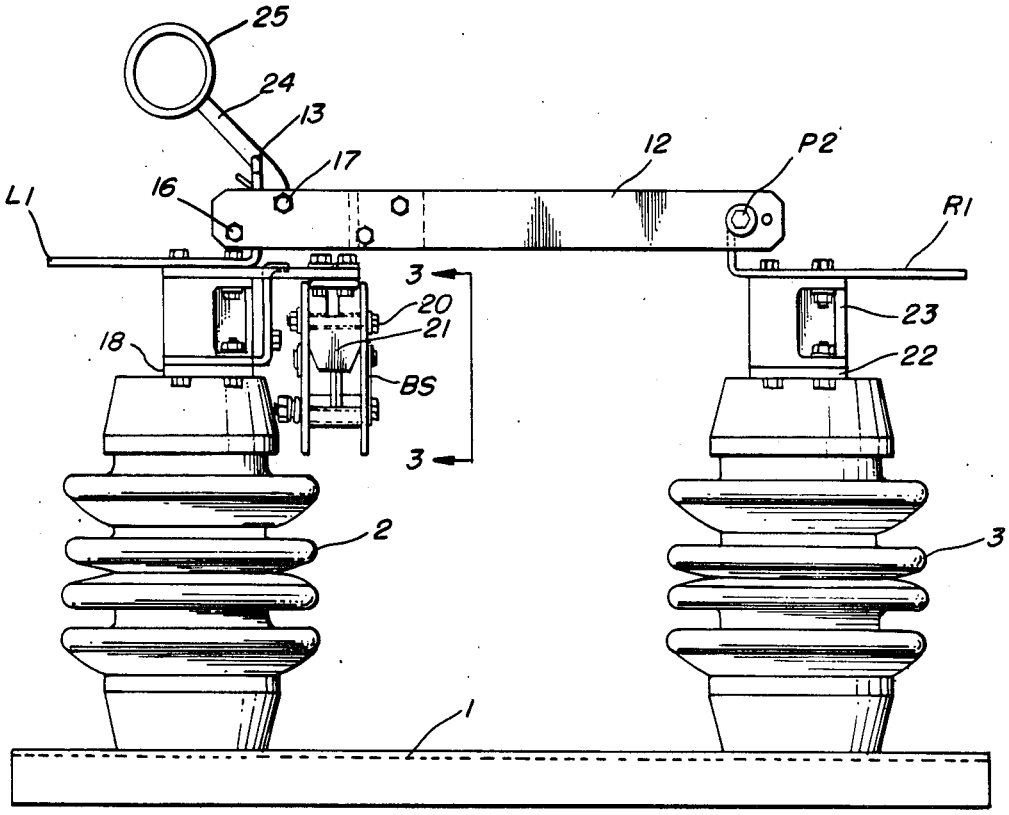
FIG. 1 is a side view of a disconnect switch embodying the invention.
Figure 2:
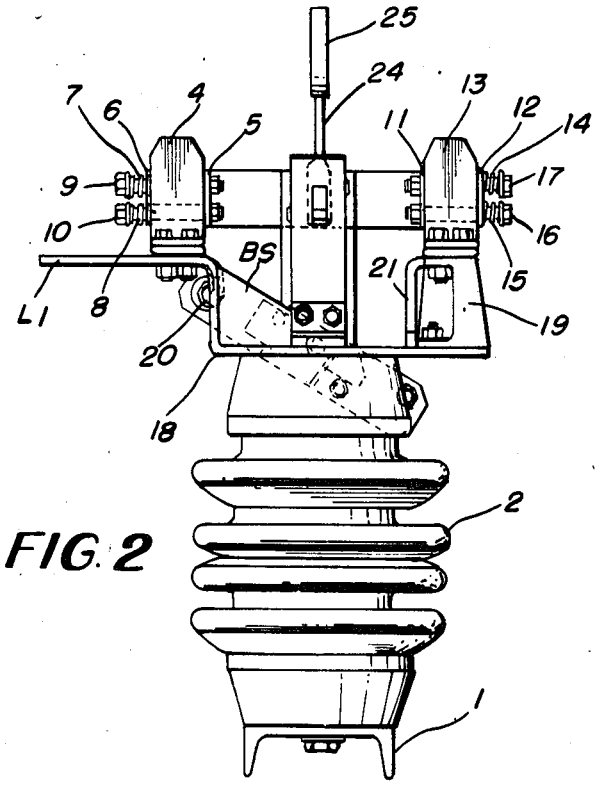
FIG. 2 is an end view taken from the left hand end of FIG. 1.
Figure 3:
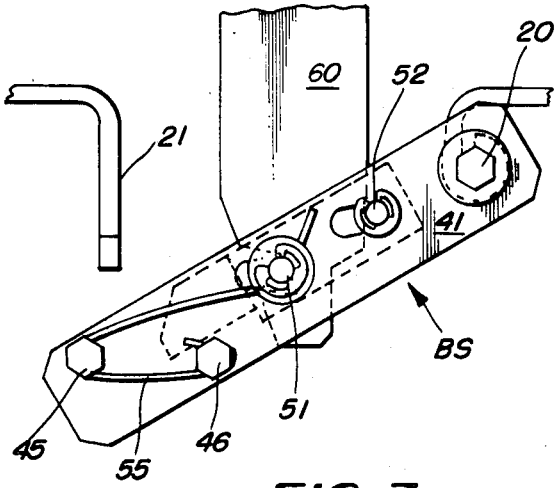
FIG. 3 is an enlarged view taken from the vantage point of the plane designated 3—3 in FIG. 1.
Figure 4:
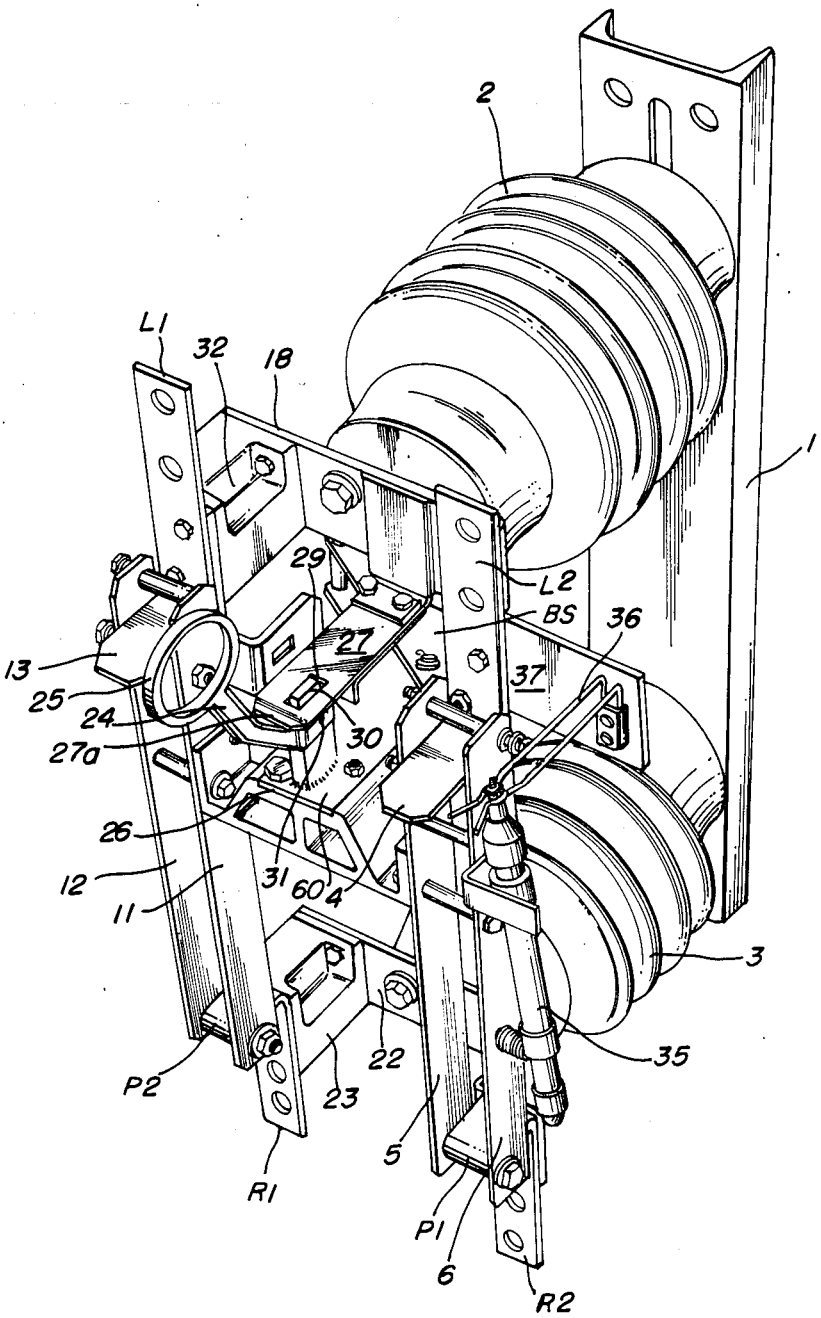
FIG. 4 is a perspective view of the switch shown in FIGS. 1–3 with the main disconnect switch blades in closed position and with the by-pass switch open.

With reference to FIGS. 1, 2, and 4, the switch is mounted on a base structure such as a channel 1 to which are secured a pair of insulators 2 and 3. Terminal L1 is arranged for connection to a power line conductor and in turn is connected with one of the main fixed contacts 4 which in turn cooperates with a pair of main contact blades 5 and 6 which are pivoted at fixed pivot P1 and connected to terminal R1 to which one terminal of an electric device such as a regulator is connected. Blades 5 and 6 are biased toward each other by compression springs 7 and 8 which are disposed about bolts 9 and 10 respectively.

Main movable blades 11 and 12 are pivoted at pivot P2 and cooperate with main fixed contact 13.

Blades 11 and 12 are biased into snug engagement with main fixed contact 13 by compression springs 14 and 15 disposed about bolts 16 and 17.

A generally Z-shaped element 18 is secured atop insulator 2 to which main fixed contact 4 is secured. An insulator 19 is secured atop Z-shaped element 18 and main fixed contact 13 is secured atop insulator 19. By-pass switch BS is elongated and pivoted at fixed pivot 20 interconnected with main fixed contact 4 and cooperates with downwardly extending fixed contact 21 interconnected with main fixed contact 13.

A cross piece 22 is secured atop insulator 3 and insulator 23 is secured atop cross piece 22 while the terminal R1 is mounted atop the insulator 23.

For imparting operating movement to the main movable blades 5, 6 and 11, 12 an operating arm 24 having a ring 25 for receiving an operating device such as a hook stick is secured to insulating structure 26 which extends between main movable blade 5 and main movable blade 11.

For securing the main movable contacts 5, 6, 11 and 12 in closed position, a yieldable plate 27 is secured atop cross piece 18 which in turn is mounted atop insulator 2 and includes an aperture 29 for receiving a projection 30 formed integrally with operating arm 24. Operating arm 24 is pivoted at fixed pivot 31. To facilitate locking action of the projection 30 into the aperture 29, the yieldable plate 27 is bevelled as indicated at 27*a*. During opening of the main movable contacts, arm 24 rotates counterclockwise as viewed in FIGS. 4 and 5 about pin 31 and the U-shaped tab 24*a* of arm 24 engages and bends yieldable element 27 upwardly to allow projection 30 to move out of aperture 29.

For insulating main fixed contact 13 from main fixed contact 4, an insulator 32 is mounted atop cross plate 18 and supports the terminal L1 as well as structure associated with main fixed contact 13.

For interrupting the flow of current when main movable switch elements 5, 6, 11 and 12 are moved to the open position, an interrupter 35 is provided and is electrically connected with main movable blade 6 and cooperates with yieldable contact 36 securely mounted atop cross plate 37 secured to terminal L2. Interrupter 35 and its associated flexible terminals 36 are well known and simply operate to interrupt whatever current that may be flowing after the main movable contact blades are opened.

The by-pass switch formed according to this invention and as shown for example in FIGS. 3 and 6–12 includes a pair of blades 40 and 41 which are pivotally mounted at 20 and are electrically connected with main fixed contact 4. Blades 40 and 41 cooperate with fixed by-pass switch contact 21 and included compression springs 43 and 44 which are disposed about bolts 45 and 46 and which function in known manner to maintain contact pressure on the fixed by-pass switch contact 21.

Figures 5, 5A:
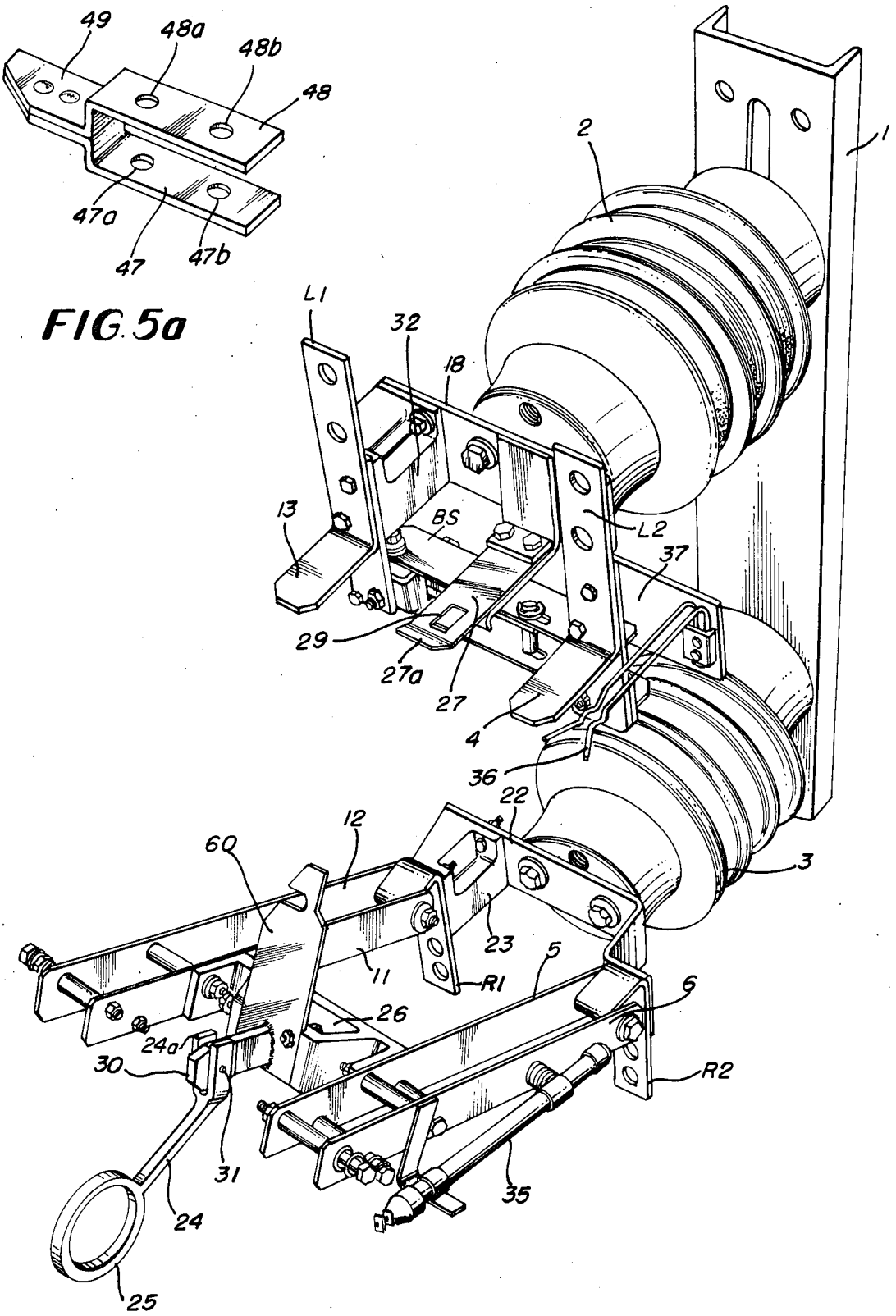
FIG. 5 is a perspective view similar to FIG. 4 but which shows the main switch blades in open position and with the by-pass switch closed.
FIG. 5*a* is an enlarged perspective view of a latch element formed according to this invention.
Figure 6:
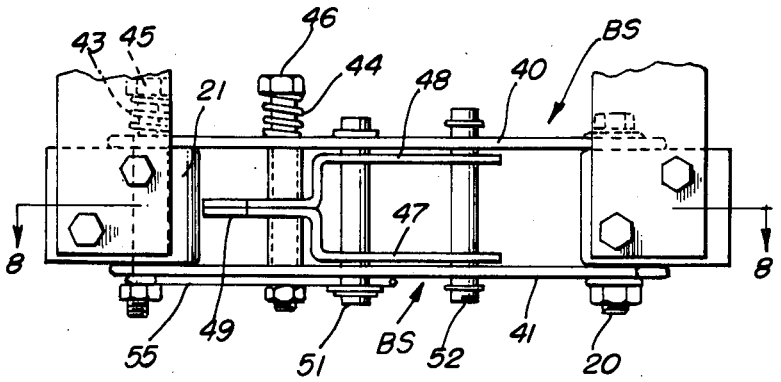
FIG. 6 is an enlarged view from below of the by-pass switch and its associated latching structure formed according to this invention.
Figure 7:
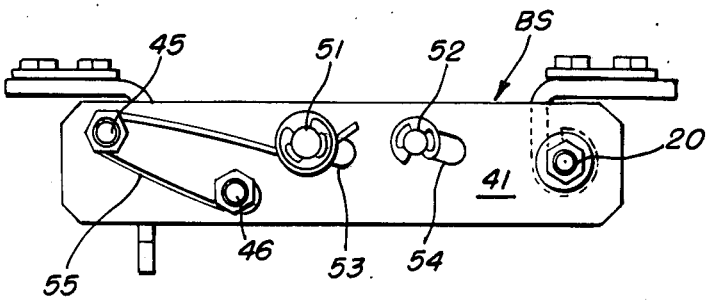
FIG. 7 is a front view of the structure shown in FIG. 6.

For holding the by-pass switch BS closed, latch means as shown in perspective in FIG. 5*a* is provided and includes a pair of complementary parts 47 and 48 which include apertures 47*a* and 47*b* as well as 48*a* and 48*b*. The left hand end of the elements 47 and 48 come together and form an extension 49 which is received within an opening 50 formed in fixed by-pass contact 21. Cross pin 51 is mounted fixedly within apertures 47*a* and 48*a* while pin 52 is mounted within apertures 47*b* and 48*b* and constitute parts of the latch means. Contact blade 41 includes a pair of elongated slots 53 and 54 while corresponding slots are formed in blade 40.

For imparting a biasing action generally toward the left to pin 51 and in turn to the latch 47-49, a yieldable spring 55 is secured about pins 45, 46 and 51.

For imparting latching and unlatching movement to the latch 47-49 and for operating the by-pass switch BS, an actuator 60 is securely affixed to the insulator structure 26 which is securely affixed to the main blades 5, 6, 11 and 12. Actuator 60 is provided with a ramp 61 and with a generally transverse slot 62.

Figure 8:
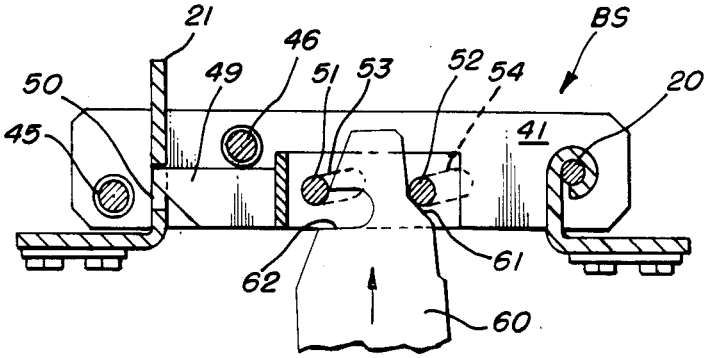
FIG. 8 is a cross sectional view taken along the line designated 8—8 in FIG. 6 and which shows the by-pass switch in closed position with its latch in latched condition.
Figure 9:
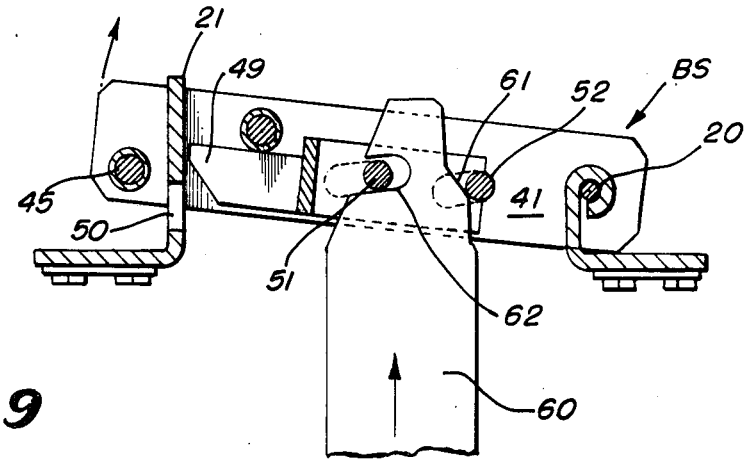
FIG. 9 is a view similar to FIG. 8 but which shows the by-pass switch latch in unlatched condition and with the by-pass switch in the initial stages of an opening operation.
Figure 10:
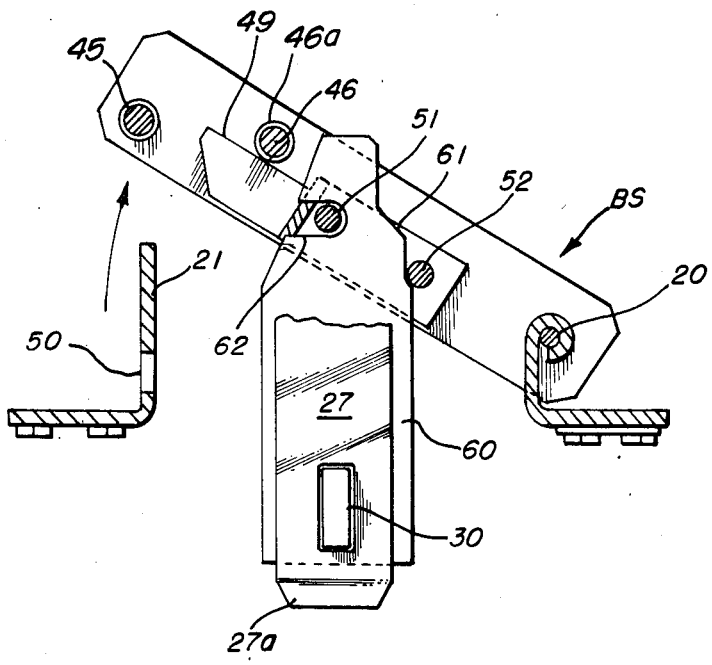
FIG. 10 is a view similar to FIG. 9 but which shows the by-pass switch in fully opened condition.

In FIG. 8, the by-pass switch BS is shown in closed position with the blades 40 and 41 in secure contact with the fixed by-pass contact 21 and with the latching part 49 in latching engagement with the opening 50 formed in contact 21. FIG. 8 also shows the actuator 60 as its upward movement is beginning. At this stage, the ramp 61 is approaching the ramp pin 52. Continued movement to the position depicted in FIG. 9 causes the pin 52 to ride down and off of the ramp 61 and imparts sliding movement generally toward the right to the latch 49 so that that latch moves out of the aperture 50 and conditions the by-pass switch BS to open by swinging in a clockwise direction about the pivot 20. This action is shown at a continuing stage in FIG. 10 wherein the pin 46 and its sleeve 46*a* are shown in contact with the latch 49 and with the pin 51 disposed within the transverse slot 62 formed in actuator 60.

Figure 11:
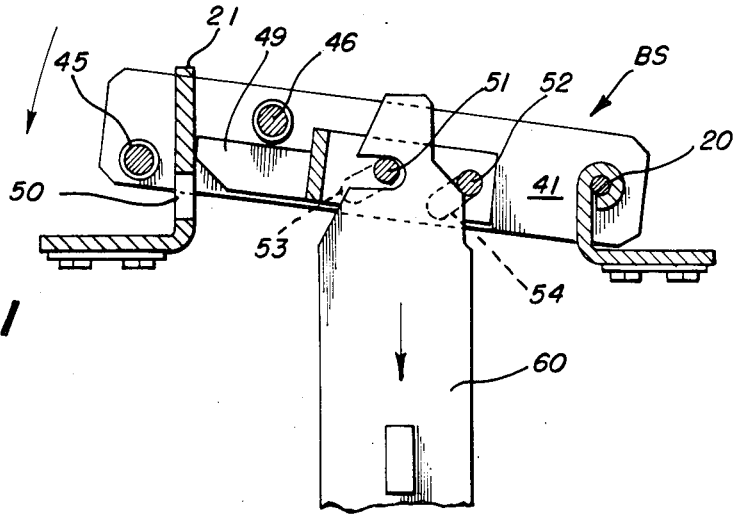
FIG. 11 is a view similar to FIGS. 8–10 but which shows the by-pass switch during a switch closing operation but prior to latching of the by-pass switch closed.

FIG. 11 depicts the parts of the by-pass switch BS during a closing operation of the by-pass switch. At this time, the by-pass switch BS is moving in a counterclockwise direction about the fixed pivot 20 and the actuator 60 is moving downwardly. This downward movement causes the pins 51 and 52 to move generally downward and toward the left due to the angular disposition of the slots 53 and 54 formed in blade 41 together with corresponding slots formed in blade 40 and urges the latch 49 toward the left. Of course the bias of spring 55 is also toward the left.

Figure 12:
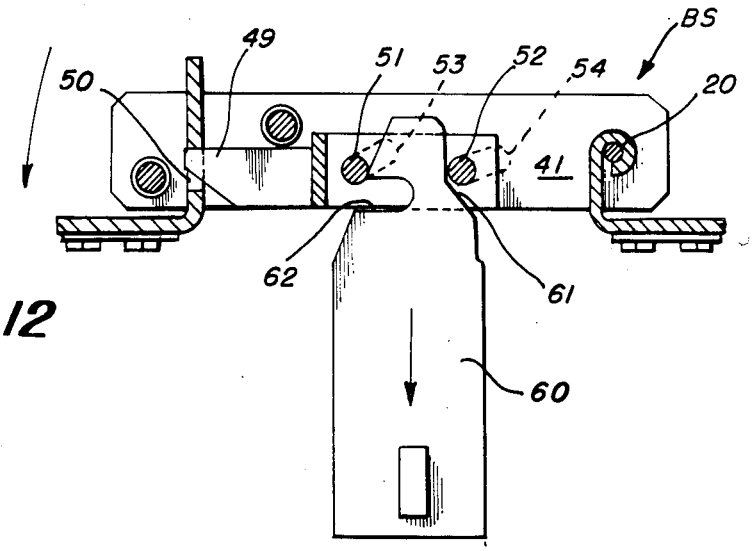
FIG. 12 is a view similar to FIGS. 8–11 which shows the by-pass switch fully closed and latched in closed position.

FIG. 12 shows the latch 49 securely closed at which time pin 51 has moved outside of the transverse slot 62 and the pin 52 is disposed at the upper end of ramp 61 in a position of readiness to effect an unlatching operation in coordination with subsequent upward movement of actuator 60 as previously explained.

INDUSTRIAL APPLICABILITY

A by-pass disconnect switch formed according to this invention is useful in connection with electric systems capable of handling currents of substantial magnitude. According to a principle aspect of the invention, large high capacity currents are precluded from magnetically forcing the by-pass switch into the open circuit condition and protection is thus affored by the invention against severe damage to the switch itself and possibly to associated apparatus as well.

I claim:

1. An electric switch comprising a pair of main fixed contacts insulated from each other, a pair of main movable contacts arranged to engage and to disengage said main fixed contacts respectively and insulated from each other, a an elongated by-pass switch electrically connected with and pivotally mounted at one end on one of said main fixed contacts and having its other end arranged electrically to connect and to disconnect the other of said main fixed contacts, latch means movably mounted on said by-pass switch and arranged to latch said by-pass switch closed whereby said fixed contacts are electrically interconnected, and actuator means mounted on and movable with said main movable contacts for engaging and imparting latching movement to said latch means in coordination with opening movement of said main movable contacts.

2. An electric switch according to claim 1 wherein said by-pass switch includes a pair of elongated slots angularly inclined with respect to the major axis of said by-pass switch in the direction of closing movement of said by-pass switch, and a pair of pins disposed within said slots respectively and fixedly mounted on said latch means, said actuator means being engageable with one of said pins for imparting closing movement to said by-pass switch.

3. An electric switch according to claim 2 wherein the angular inclination of said slots imparts sliding movement to said latch means generally toward said other main fixed contact.

4. An electric switch according to claim 2 wherein a fixed by-pass switch contact is electrically connected with said other main fixed contact and engageable with said by-pass switch in coordination with opening movement of said main movable contacts, and a latching slot formed in said fixed by-pass switch contact for receiving a pair of said latch means whereby said by-pass switch is latched closed.

5. An electric switch according to claim 2 wherein said actuator means includes a transverse slot in which said one pin is disposed during closing movement of said by-pass switch.

6. An electric switch according to claim 1 wherein biasing means is mounted on said by-pass switch and arranged to urge said latch means toward its latching position.

7. An electric switch according to claim 1 wherein said by-pass switch is latched closed before said main movable contacts disengage said main fixed contacts.

8. An electric switch according to claim 1 wherein a circuit interrupter is mounted on and electrically connected with one of said main movable contacts and engageable with a flexible connector mounted on the associated one of said main fixed contacts for interrupting the current flowing through said one main movable contact and said one main fixed contact after separation of said one main fixed contact and said one main movable contact.

9. An electric switch according to claim 8 wherein said interrupter and said connector are disjointably interrelated when said one of said main movable contacts and said one of said main fixed contacts are closed.

10. An electric switch according to claim 1 wherein said actuator means includes a ramp engageable with a part of said latch means during closing movement of said main movable contacts whereby said latch means is moved to an unlatching position and said by-pass switch effects electrical disconnection of said main fixed contacts.

11. An electric switch according to claim 10 wherein said movable contacts are moved into engagement with said fixed contacts prior to opening of said by-pass switch during a switch closing operation.

12. An electric switch according to claim 10 wherein said ramp is engageable with a pin fixedly mounted on said latch means for imparting unlatching movement to said latch means during closing of said main movable contacts.

13. An electric switch according to claim 10 wherein a yieldable plate having an aperture thereon is fixedly mounted between said main fixed contacts so that said aperture receives a projecting part mounted generally between said movable contacts and movable therewith for securing said main movable contacts closed.

14. An electric switch according to claim 10 wherein a pin is mounted on and movable with said by-pass switch and engageable by said latch means for imparting opening movement to said by-pass switch.

15. An electric switch according to claim 13 wherein an operating arm is pivotally mounted on said locking part and includes a tab for engaging said yieldable plate for moving said yieldable plate to a position wherein said locking part moves out of said aperture for releasing said main movable contacts for opening movement in coordination with pivotal movement of said operating arm.

* * * * *